US006585103B2

(12) United States Patent
Meyer

(10) Patent No.: US 6,585,103 B2
(45) Date of Patent: Jul. 1, 2003

(54) SUCTION ROLLER

(75) Inventor: Gerhard Meyer, Neusäss (DE)

(73) Assignee: Franz Gremser GmbH & Co. KG, Neusass (DE)

( * ) Notice: Subject to any disclaimer, the term of this patent is extended or adjusted under 35 U.S.C. 154(b) by 47 days.

(21) Appl. No.: 09/842,623

(22) Filed: Apr. 27, 2001

(65) Prior Publication Data

US 2002/0005613 A1 Jan. 17, 2002

(30) Foreign Application Priority Data

May 13, 2000 (DE) ..... 100 23 498

(51) Int. Cl.[7] ..... B65G 47/04
(52) U.S. Cl. ..... 198/471.1; 198/689.1
(58) Field of Search ..... 198/689.1, 471.1; 414/797; 271/98, 112, 132

(56) References Cited

U.S. PATENT DOCUMENTS 2,093,437 A * 9/1937 Gwinn ..... 198/471.1 X
3,612,313 A * 10/1971 Lehring, Jr. ..... 198/689.1
3,901,373 A * 8/1975 Rudzinat ..... 198/471.1
4,381,212 A * 4/1983 Roberts ..... 271/112 X
4,771,879 A * 9/1988 Shriver ..... 198/471.1
5,931,635 A * 8/1999 Barthold ..... 414/797 X

FOREIGN PATENT DOCUMENTS

SU 1284913 * 1/1987 ..... 271/112

* cited by examiner

*Primary Examiner*—James R. Bidwell
(74) *Attorney, Agent, or Firm*—Jones, Tullar & Cooper, PC

(57) ABSTRACT

In a suction roller for the movement of sheet-shaped workpieces, particularly for their acceleration or braking, economical production and a design advantageous for flow technology are achieved by providing a wheel body having channels starting at one face, which are open on at least one side and which rotate in sequence past a fixed suction nozzle positioned on one face, as well as a surrounding band (toothed belt) applied to the external circumference of the wheel body with protrusions (teeth) extending outward and indentations between them, with each indentation connected by means of at least one connection boring with a channel.

13 Claims, 1 Drawing Sheet

SUCTION ROLLER

FIELD OF THE INVENTION

The invention concerns a suction roller for the movement of sheet-shaped workpieces, particularly for their acceleration or braking.

BACKGROUND OF THE INVENTION

These types of suction rollers are used, for example, to accelerate a sheet lifted from a stack to the speed of a downstream conveyor.

SUMMARY OF THE INVENTION

The invention has as its object the provision of a suction roller according to the generic portion with a simple design which can be produced economically and with efficient flow technology.

A wheel body having channels starting at one face which are open on at least one side and which rotate in sequence past a fixed suction nozzle positioned on one face, as well as a surrounding band applied to the external circumference of the wheel body with protrusions extending outward and indentations between them, with each indentation connected by means of at least one connection boring with a channel, are provided to achieve this object.

The wheel body advantageously consists of a hard plastic. This can easily be bored to produce the channels. The band is preferably implemented as a toothed belt which is manufactured from an elastic material. The toothed belt is then applied to the wheel body under tension. In this embodiment, special means for attachment of the toothed belt to the wheel body are no longer necessary. If a toothed belt is used, the teeth, which extend outward and are continuous over the width of the belt, provide protrusions, and the gaps between them provide indentations, in a very simple way. These indentations preferably run parallel to the axis, so that their entire width can be reliably covered by a sheet held on by suction.

According to a further embodiment of the invention, the protrusions of the band, preferably formed by the teeth of the toothed belt, have an approximately rectangular cross-section with an external surface having a good grip. In this way, a large contact surface for the workpieces to be accelerated can be achieved.

The wheel body advantageously consists of a hub part having an integral covering disk with a larger diameter on one face and a covering disk which can be put onto the other face of the hub part. In this way, the band preferably implemented as a toothed belt can be easily applied to the wheel body. This measure simultaneously closes the indentations of the band and/or toothed belt on the completely assembled suction roller laterally, so that stronger suction is achieved in the individual indentations.

A particularly simple embodiment results if the removable covering disk has an internal projection with a diameter corresponding to the diameter of the hub part and can be attached to the hub part by means of the elastic band preferably implemented as a toothed belt. In this way, the wheel body and the loose covering disk can be attached by means of the band and/or toothed belt in one single work step and additional attachment means can be dispensed with.

Further characteristics and advantages result from the following description of an exemplary embodiment with reference to the drawing.

DESCRIPTION OF THE PREFERRED EMBODIMENTS

Figure 1:
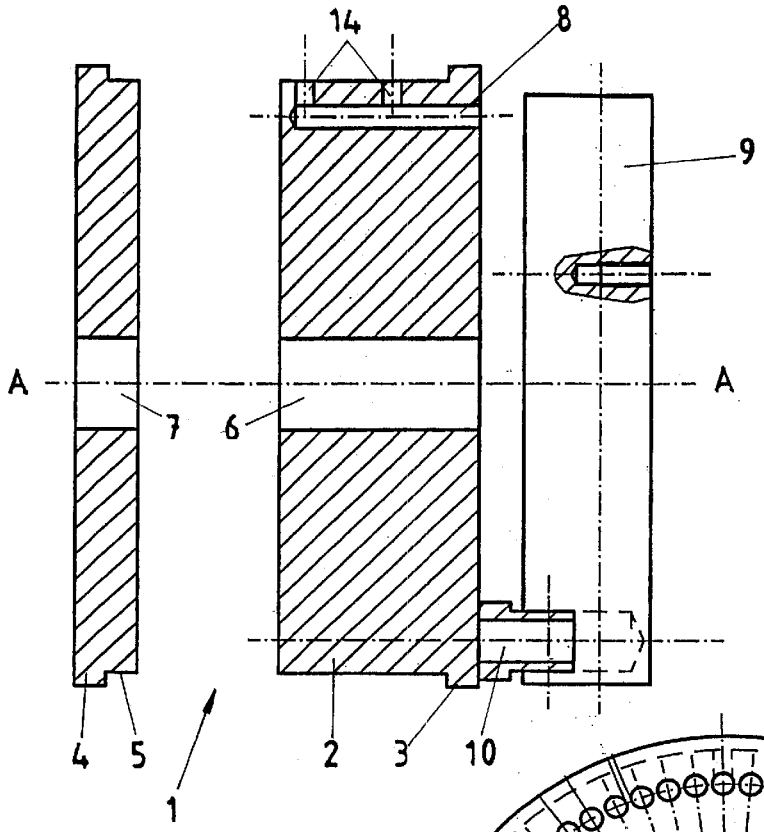
FIG. 1 shows a wheel body in section according to the present invention.

The wheel body indicated as a whole with 1 has a hub part 2 with an integral covering disk 3. Furthermore, a covering disk 4 is provided which can be put onto the hub part 2. The hub part 2 and the covering disks 3, 4 are preferably produced as lathed parts fror a hard plastic, for example a polyurethane or an artificial rubber. The diameter of the covering disks 3, 4 is implemented as somewhat larger than the diameter of the hub part 2, so that they form an edge projecting over the diameter of the hub part 2. The separately produced covering disk 4 has a continuous projection 5 whose diameter is equal to the diameter of the hub part 2.

Figure 2:
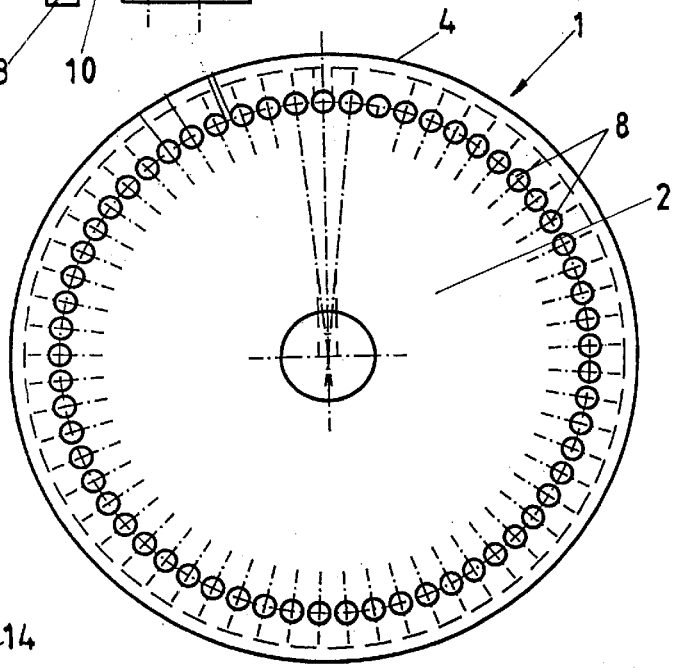
FIG. 2 shows a front view of the wheel body of FIG. 1.

The hub part 2 and the covering disks 3, 4 have central borings 6, 7 which serve to accommodate a driveshaft (not shown). A number of channels 8 are provided on the circumference of the hub part 2 with the covering disk 3 which are open on one side to the face of the covering disk 3 and run parallel to the axis A—A of the wheel body 1. As FIG. 2 shows, the channels are positioned close to one another. In the exemplary embodiment depicted, the channels are implemented as pocket holes.

A fixed carrier 9 located in front of the face of the covering disk 3 forms the holder for a suction nozzle 10 extending up to the face of the covering disk 3 and fitting tightly against it. The suction nozzle 10 is attached to a suction generator in a way not shown in more detail. The free cross-sectional area of the suction nozzle 10 is implemented so that it is large enough to cover the free cross-sectional area of two adjacent channels 8. As the wheel body 1 rotates, a maximum of three channels 8 are therefore acted upon by the suction. The two outer channels 8 are hereby briefly only partially connected with the suction generator to build up or reduce the suction.

Figure 3:
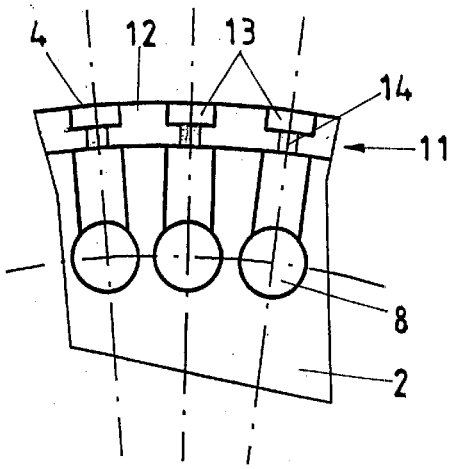
FIG. 3 shows a detail of the wheel body to an enlarged scale.

A toothed belt indicated as a whole with 11 is, as shown in FIG. 3, wrapped around the hub part 2 and the projection 5 between the covering disks 3, 4 in the completely assembled suction roller. The toothed belt 11 is manufactured from an elastic material and has teeth 12 and indentations 13 between them. The teeth 12 have an approximately rectangular cross-section. Their external side, which is implemented, i.e. roughened, for example, to have a good grip, terminates for practical purposes with the external side of the covering disks 3, 4. To assemble the suction roller, the toothed belt 11, which is, for practical purposes, implemented as endless, is applied under tension to the hub part 2. The covering disk 4 is then put on. The projection 5 is hereby inserted under one edge region of the toothed belt 11 so that the toothed belt also holds the covering disk 4 in the position in which it is put on.

The channels 8 are positioned in such a way that each indentation 13 is allocated one channel 8. After mounting of the toothed belt 11 and the covering disk 4, borings 14 are inserted through the toothed belt and the hub part 2, connecting each indentation 13 with one channel 8. The suction nozzle 10 is hereby positioned in such a way that the indentations 13, on which the sheet-shaped workpiece is placed, are connected with the suction generator via the associated borings 14 and channels 8. Because the indentations 13 are closed on five sides and have a sheet-shaped workpiece lying on the sixth side, the workpiece is held onto the suction roller 1 by a very effective vacuum.

The invention is not restricted to the exemplary embodiment depicted. Thus, the channels could also be implemented as through borings, which are then closed by the covering disk put onto one end. The loose covering disk could also be attached by other known means to the hub part. Instead of the covering disks, the toothed belt could also be provided with lateral peripheral edges.

What is claimed is:

1. A suction roller for the movement of sheet-shaped workpieces, particularly for their acceleration or braking, whereby a wheel body having channels starting at one face, which are open on at least one side and which rotate in sequence past a fixed suction nozzle fitting closely against one face, as well as a surrounding band applied to the external circumference of the wheel body with protrusions extending outward and indentations between them, with each indentation connected by means of at least one connection boring with a channel, said protrusions having an approximately rectangular cross section with an external surface having a good grip.

2. A suction roller according to claim 1, whereby the wheel body consists of a hard plastic.

3. A suction roller according to claim 1, whereby the band is manufactured from an elastic material.

4. A suction roller according to claim 3, whereby the band is applied to the wheel body under tension.

5. A suction roller according to claim 1, whereby the band is manufactured as endless part.

6. A suction roller according to claim 1, whereby the channels are implemented as borings parallel to the axis.

7. A suction roller according to claim 1, whereby the protrusions and indentations run parallel to the axis.

8. A suction roller according to claim 1, whereby the band is implemented as a toothed belt.

9. A suction roller according to claim 1, whereby the protrusions extending outward are implemented as teeth.

10. A suction roller according to claim 1, whereby the free cross-sectional area of the suction nozzle covers the cross-sectional areas of two adjacent channels.

11. A suction roller for the movement of sheet-shaped workpieces, particularly for their acceleration or braking, whereby a wheel body having channels starting at one face, which are open on at least one side and which rotate in sequence past a fixed suction nozzle fitting closely against one face, as well as a surrounding band applied to the external circumference of the wheel body with protrusions extending outward and indentations between them, with each indentation connected by means of at least one connection boring with a channel, said wheel body consisting of a hub part with an integral covering disk of larger diameter on one face and a covering disk which can be put onto the other face of said hub part.

12. A suction roller according to claim 11, whereby the parts of the wheel body are manufactured as lathed parts.

13. A suction roller according to claim 11, whereby the covering disk which can be put on has an internal projection with a diameter corresponding to the diameter of the hub part and can be attached by means of the elastic toothed belt to the hub part.

* * * * *